US009125441B2

(12) United States Patent
Maier

(10) Patent No.: US 9,125,441 B2
(45) Date of Patent: Sep. 8, 2015

(54) SPORTS GARMENT WITH A SEAT PAD, IN PARTICULAR FOR CYCLING

(75) Inventor: Roger Maier, Carona (CH)

(73) Assignee: ASSOS OF SWITZERLAND S.A., San Pietro di Stabio (CH)

( * ) Notice: Subject to any disclaimer, the term of this patent is extended or adjusted under 35 U.S.C. 154(b) by 609 days.

(21) Appl. No.: 13/402,686

(22) Filed: Feb. 22, 2012

(65) Prior Publication Data

US 2012/0222191 A1 Sep. 6, 2012

(30) Foreign Application Priority Data

Mar. 2, 2011 (EP) ..... 11156666

(51) Int. Cl.
*A41D 1/08* (2006.01)
*A41D 13/05* (2006.01)

(52) U.S. Cl.
CPC ..... *A41D 1/084* (2013.01); *A41D 1/088* (2013.01); *A41D 13/0537* (2013.01)

(58) Field of Classification Search
CPC .... A41D 13/0537; A41D 1/084; A41D 1/088
USPC ..... 2/79, 228, 466, 238, 227, 401, 214, 2/215, 455, 467, 23; 450/153, 97–100, 450/104
See application file for complete search history.

(56) References Cited

U.S. PATENT DOCUMENTS

| | | | | |
|---|---|---|---|---|
| 4,805,243 | A * | 2/1989 | Gibbens et al. | 2/228 |
| 2003/0131399 | A1* | 7/2003 | Forsyth et al. | 2/401 |
| 2005/0009446 | A1 | 1/2005 | Arnold | |
| 2005/0066423 | A1* | 3/2005 | Hogan | 2/227 |
| 2005/0223478 | A1* | 10/2005 | Hogan | 2/466 |
| 2008/0229486 | A1* | 9/2008 | Maier | 2/401 |
| 2010/0095432 | A1* | 4/2010 | Liou | 2/227 |

FOREIGN PATENT DOCUMENTS

| | | | |
|---|---|---|---|
| DE | 201 08 582 | U1 | 10/2002 |
| EP | 1 269 873 | A1 | 1/2003 |
| EP | 1 430 797 | A2 | 6/2004 |

* cited by examiner

*Primary Examiner* — Danny Worrell
*Assistant Examiner* — Khaled Annis
(74) *Attorney, Agent, or Firm* — Lucas & Mercanti, LLP

(57) ABSTRACT

A sports garment, for example a cycling suit, comprises a seat pad located in a crotch area, the seat pad is attached to the garment in a front attachment region and in a rear attachment region of the seat pad, and a central portion of the seat pad is free from attachment to the garment and forms as a loose portion in the inner crotch area of the garment; said attachment regions are made with attachment lines or several attachment points, made by stitching, glueing or other techniques.

12 Claims, 3 Drawing Sheets

SPORTS GARMENT WITH A SEAT PAD, IN PARTICULAR FOR CYCLING

CROSS-REFERENCE TO RELATED APPLICATION

This patent application claims the benefit of priority from European Patent Application No. EP 11156666, filed Mar. 2, 2011, the contents of which are incorporated herein by reference.

FIELD OF THE INVENTION

The invention relates a sports garment, in particular for cycling. The invention relates in particular to a sports garment such as cycling trousers, with a seat pad in the crotch area, and to a technique for fixing said seat pad to the garment.

BACKGROUND OF THE INVENTION

Known cycling trousers are equipped with a seat pad made of a soft material for protection of perineal and/or ischiatic parts of the body, which are in contact with the saddle of the bicycle and may cause discomfort or pain during intensive use. According to the prior art, said seat pad usually comprise a plurality of layers of soft materials, capable of damping bumps and fatigue stresses, and fabric layers in contact with the skin.

EP-A-1269873 discloses trousers for cyclists with a seat pad in the form of an insert which is composed of a base layer of expanded material and an elastic fabric in contact with the body of the user.

EP-A-1430797 discloses sports trousers and shorts with protective lining consisting of a piece of lining or seat panel lining, the shorts being manufactured from an elastic woven or knitted fabric and the lining consisting of an elastic soft material, where the lining is attached to the elastic woven or knitted fabric of the shorts at selected points distributed along the edge of the lining.

In the manufacture of cyclist trousers, there is a continuous effort to improve the performance and comfort of the seat pad, especially for intensive use. In particular, adaptation and close fit to the body as well as proper support of the perineal area of the user are two of the most important requirements of a cycling suit.

SUMMARY OF THE INVENTION

The aim of the invention is to still improve the comfort of the soft pad of a sports or cycling trousers and ability to follow the pedalling movement while maintaining a satisfying padding action.

These aims are reached with a skin-tight sports garment described herein, comprising at least a portion acting as trousers and a seat pad located in a crotch area, the seat pad seat pad comprising a front attachment region to the garment and a rear attachment region to the garment, a central portion of the seat pad being free from attachments to the garment and thus forming a loose bridge portion of the seat pad in the inner crotch area of the garment.

Said front attachment region and rear attachment region are the sole attachments between the seat pad and the crotch area of the garment. Hence, the loose bridge portion, which connects a front portion and a rear portion of the seat pad, is substantially free to move relative to the skin-tight garment, and in particular relative to the trousers and crotch area.

Either of said front attachment region and rear attachment region may comprise at least a continuous attachment line and/or a plurality of attachment points, i.e. the attachment(s) between the seat pad and trousers may be either in a distributed or localized form. In embodiments with a plurality of attachment points, said points are preferably evenly spaced. Mixed embodiments are also possible with one attachment region made with a continuous joining line and the other attachment region made with a plurality of attachment points.

The attachment line(s) or attachment points may be for example in the form of stitching, glueing or made with other techniques such as thermal welding. Any attachment technique which is per se known could be used to realize the attachment lines or points, according to embodiments of the invention.

The loose bridging portion of seat pad is delimited by ends of the front attachment region and rear attachment region, either realized as continuous line or plurality of attachment points. Preferably, the distance between a left or right end of the front attachment region and a correspondingly left or right end of the rear attachment region is at least 5 cm to allow the loose-fitting effect of the bridging portion of the seat pad. Said distance is measured on the projection of the seat pad on a line parallel to a longitudinal median axis of the seat pad, as above.

In the embodiments of the invention featuring a plurality of attachment points, namely a first plurality of attachment points between the trousers and the front region of the seat pad, and a second plurality of attachment points between the trousers and the rear region of the seat pad, the above preferred minimum distance is measured between a left or right end attachment point of the front region and a correspondingly left or right end attachment point of the rear region.

The front part and/or the rear part of the seat pad may have a concave shell shape is suitable for making the sports trousers more anatomical and wearable.

Details of the seat pad can be realized according to several techniques which are known per se. The seat pad is realized with a soft material and may comprise for example one or more soft sponge elements inserted in a fabric pocket.

The advantage of the invention is that the seat pad is securely attached to the garment by the front and rear attachment regions, i.e. the seat pad remains adherent to the garment in the crucial front/rear crotch regions where the body needs the maximum of padding effect. The loose central region, however, increases the comfort and ability to precisely follow the movements of the body. In particular, the front and rear regions of the seat pad are made virtually independent from each other, though being part of the same seat pad. In a cycling suit or trousers, for example, the skin-tight trousers can better fit and follow the alternate movement of the legs while pedalling without being impaired by the presence of the soft pad inside; the seat pad can freely twist under the pedalling action, since only the front and rear portions are secured to the trousers, while the central, bridging portion remain substantially free. Hence, the soft pad is also able to offer better adaptation to the body and especially a better support for male genitals.

The invention is based on the finding that a best performance is achieved without joining the seat pad along its entire perimeter with a continuous attachment line or several attachment points, e.g. stitching or welding points, close together. It has been found that leaving a substantially free, loose bridge portion of the seat pad, between the front and rear regions attached to the cycling trousers, has an advantageous effect.

It should be noted that the term of sports garment as used in this description may encompass a garment consisting of shorts or long trousers, or a garment comprising a trousers portion, e.g. an integral body. More in detail, the term of cycling garment is directed to a wear item suitable for use in the sport of cycling, like for example shorts or long trousers, overalls, tights body suit and similar. The term seat pad is used to identify the shaped pad that is associated with the trousers or formed in the trousers themselves, to protect the perineal area of the body, which during the use is in contact with the bicycle saddle.

Another aspect of the invention is a method for making a sports garment such as a cycling suit, the garment comprising at least a portion acting as trousers, the method comprising the steps of attaching a spat pad to a crotch area of said garment, the method being characterized in that a front portion of the seat pad is attached to the suit, and a rear portion of the seat pad is attached to the suit, leaving a central portion of the seat pad, between said front and rear regions, free from attachment to said suit, thus leaving a loose bridge portion of the seat pad in the inner crotch area of the garment.

These and further advantages of the invention will be elucidated with the following detailed description of indicative and not limiting examples.

DETAILED DESCRIPTION OF THE INVENTION

Figure 1:
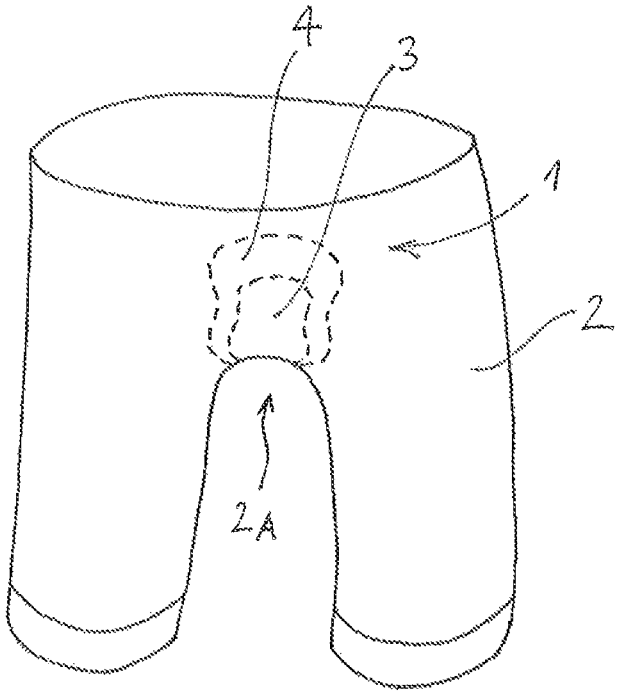
FIG. 1 is view of a cycling trousers realized in accordance with an embodiment of the invention.

FIG. 1 shows a seat pad 1 which is attached to the crotch area $\mathbf{2}_A$ of a skin-tight garment, in the example cycling trousers 2. The seat pad 1 is attached inside the cycling trousers 2 and is indicated by the dotted lines of FIG. 1. In equivalent (not shown) embodiments the inventive garment may have a different form, e.g. a cycling suit, comprising at least a portion acting as trousers.

Preferably the seat pad 1 has anatomical shape. More preferably, the front portion 3 and eventually the rear portion 4 of the seat pad 1 are formed with a shell concave shape.

The cycling trousers 2 are made preferably with an elastic woven or knitted fabric and the pad 1 is preferably made with a soft material and more preferably with a soft material which is elastic in all directions.

Figure 2:
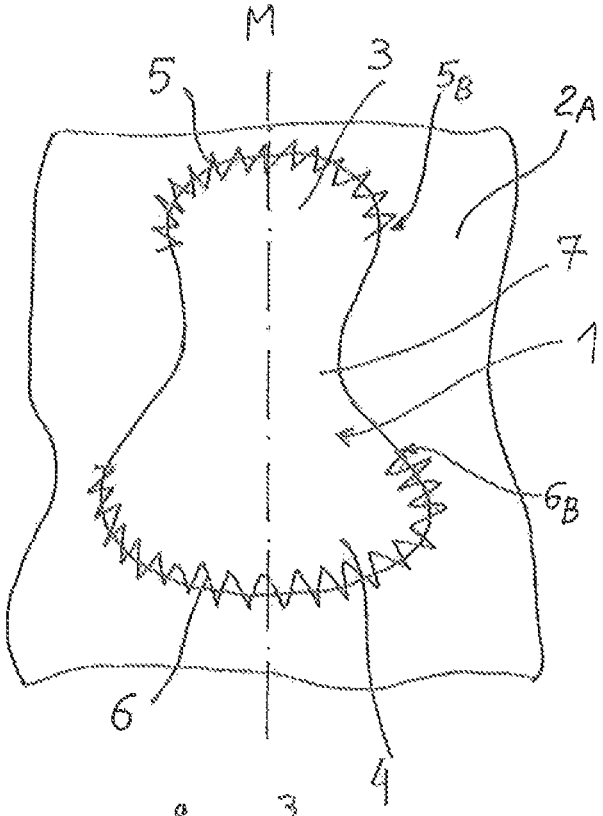
FIG. 2 is a top plane view of a seat pad attached to the crotch area of cycling trousers according to an embodiment of the invention.

Only a front portion 3 and a rear portion 4 of the seat pad 1 are attached to the trousers 2. Referring to the embodiment of FIG. 2, the front portion 3 of the seat pad 1 is directly and permanently attached to the trousers 2 along a front attachment line 5 which in the example is a stitching line but could be made with another technique, e.g. thermal welding or gluing, according to several embodiments of the invention. The rear portion 4 of the seat pad is directly and permanently attached to the trousers 2 along a rear attachment line 6 which is preferably, but not necessarily, made with the same technique of front attachment line 5. Line M is a crotch median line of the seat pad 1. Preferably the seat pad is symmetrical with respect to said line M.

Figure 5:
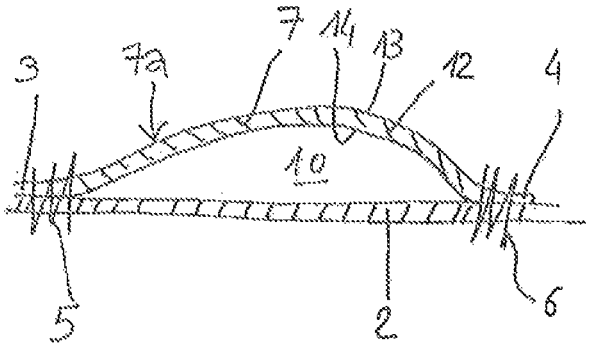
FIG. 5 is a cross section of the garment and seat pad of FIG. 2 according to a median line.

Since the only joining means between the seat pad 1 and the trousers 2 are the above front and rear attachment lines 5, 6, the remaining portion of the seat pad forms a loose bridging portion 7. As best seen in the cross section of FIG. 5, the central bridging portion 7 of the seat pad 1 is free from attachments to the trousers 2, so that said bridging portion 7 is a loose part which is substantially free to move in the middle of crotch area $\mathbf{2}_A$ of the trousers 2, leaving an air gap 10 between the surface of the trousers 2 and the seat pad itself. The surface denoted with 7*a* is the inner surface which, during the use, is in contact with the user.

The figure shows a preferred embodiment where the seat pad 1 comprises a layer of a soft material 12 inserted between fabric layers 13 and 14.

Figure 3:
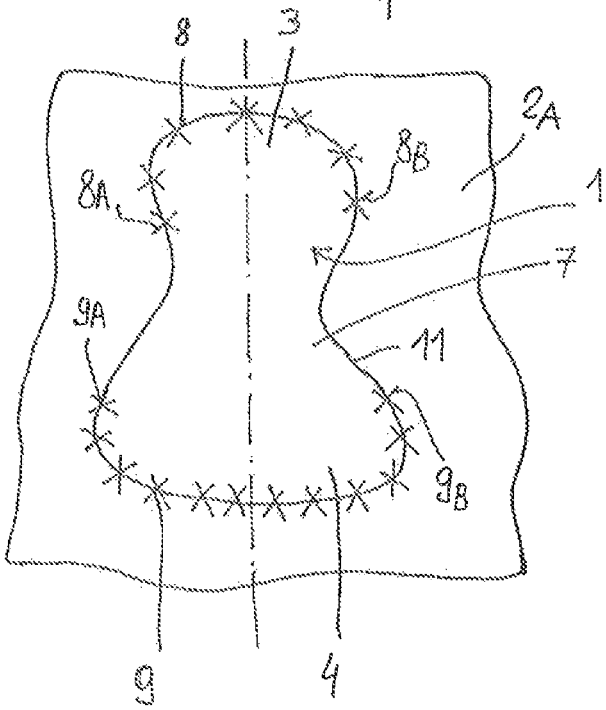
FIG. 3 is a top plane view of a seat pad attached to the crotch area of cycling trousers according to another embodiment of the invention.

Another embodiment is shown in FIG. 3, where there are a first plurality of attachment points 8 between the trousers 2 and the front region 3 of the seat pad 1, and a second plurality of attachment points 9 between the trousers 2 and the rear region 4 of the same seat pad. Also said attachment points 8, 9 may be made as stitching points, glueing or welding points, or with other suitable techniques.

The loose bridging portion 7 is delimited by left and right ends of the attachment regions of the seat pad 1. In embodiments of FIGS. 2 and 3, the loose portion 7 is delimited by ends of attachment lines 5, 6 (FIG. 2) or by left and right end attachment points such as points $\mathbf{8}_A$, $\mathbf{9}_A$ and $\mathbf{8}_B$, $\mathbf{9}_B$ (FIG. 3).

Figure 4:
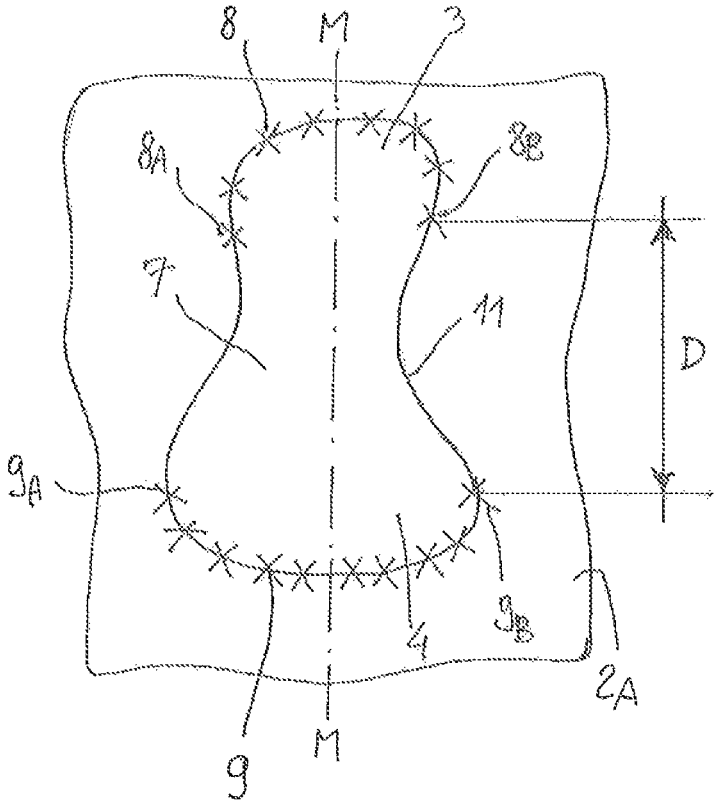
FIG. 4 shows preferred embodiments of the seat pad of the invention.

According to further preferred embodiments of the invention, a distance between the ends of the attachment regions is at least 5 cm and preferably 5 to 10 cm. Said distance is taken on the projection of the generally curvilinear edge 11 of the seat pad 1 on the median line M or a line parallel to said median line M, the seat pad and trousers being unstretched (i.e. not deformed). For example, FIG. 4 shows a multi-point embodiment as in FIG. 3, with indication of said distance D, taken between the front right end attachment point $\mathbf{8}_B$ and the corresponding rear right end attachment point $\mathbf{9}_B$. The same preferred distance is maintained between the left ends $\mathbf{8}_A$, $\mathbf{9}_A$. The above is equally applicable to the attachment-line embodiment of FIG. 2, the distance D being measured in the same manner between the ends of the attachment lines 5 and 6, e.g. between the points $\mathbf{5}_B$ and $\mathbf{6}_B$ on the right side.

No attachment point between the seat pad 1 and the trousers 2 is made in the central region corresponding to the bridging portion 7, namely between the ends of said attachment lines 5, 6 or between the end attachment points $\mathbf{8}_A$, $\mathbf{9}_A$ and $\mathbf{8}_B$, $\mathbf{9}_B$.

The invention claimed is:

1. A skin-tight sports garment comprising at least a portion of a pair of trousers and a seat pad located in a crotch area of the garment, the seat pad having a front attachment region disposed towards a front of the garment when the garment is worn extending to a rear attachment region disposed towards a rear of the garment when the garment is worn, the front attachment region and the rear attachment region each being directly and permanently fixed to the garment while a central portion of the seat pad connecting to the front attachment region and to the rear attachment region is free from attachments to the garment forming a loose bridge portion of the seat pad in an inner crotch area of the garment allowing for substantially-free movement relative to the garment during use.

2. A garment according to claim 1, the front attachment region and the rear attachment region between the seat pad and the garment each including a continuous attachment line.

3. A garment according to claim 2, the continuous attachment lines being made by stitching, gluing or thermal welding the seat pad to the inside of the garment.

4. A garment according to claim 3, the left end and right end of the front or rear attachment region being ends of continuous attachment lines, or the left and right end attachment points of respective plurality of front and rear attachment points between the seat pad and the garment.

5. A garment according to claim 1, the front attachment region and the rear attachment region between the seat pad and the garment each joined by a plurality of attachment points.

6. A garment according to claim 5, the attachment points being made by stitching, gluing or thermal welding the seat pad to the inside of the garment.

7. A garment according to claim 1, the attachment points in the front and rear attachment region being evenly spaced from each other.

8. A garment according to claim 1, a distance (D) between a left end or right end of the front attachment region and a correspondingly left end or right end of the rear attachment region is at least 5 cm, said distance being taken on a projection of a contour of the seat pad on a line parallel to a longitudinal median axis (M) of the seat pad, when the garment and the seat pad are unstretched.

9. A garment according to claim 1, a front portion and a rear portion of the seat pad having a concave shell shape suitable for making the garment more anatomical and wearable.

10. A garment according to claim 1, the garment being a cycling suit or cycling trousers.

11. A garment according to claim 1, the front and rear attachment regions are the sole attachments between the seat pad and the garment.

12. The garment according to claim 1, wherein the seat pad has a continuous fabric layer extending from the front attachment region to the rear attachment region.

* * * * *